United States Patent [19]

Yokomizo et al.

[11] Patent Number: 4,781,545

[45] Date of Patent: Nov. 1, 1988

[54] ROTARY COMPRESSOR WITH SOUND SUPPRESSION TUBULAR CAVITY SECTION

[75] Inventors: Yukio Yokomizo, Fujinomiya; Masahiko Sasaki, Fuji, both of Japan

[73] Assignee: Kabushiki Kaisha Toshiba, Kawasaki, Japan

[21] Appl. No.: 161,268

[22] Filed: Feb. 19, 1988

Related U.S. Application Data

[63] Continuation of Ser. No. 904,294, Sep. 8, 1986, abandoned.

[30] Foreign Application Priority Data

Sep. 30, 1985 [JP] Japan ..... 60-148081[U]
Jan. 31, 1986 [JP] Japan ..... 61-11615[U]

[51] Int. Cl.[4] ..... F04B 39/00; F04C 29/06

[52] U.S. Cl. ..... 417/312; 418/181; 181/230

[58] Field of Search ..... 418/63–67, 418/181; 181/225, 227, 230; 417/312

[56] References Cited

U.S. PATENT DOCUMENTS 3,429,397 2/1969 Case ..... 181/227
3,635,299 1/1972 Hayes ..... 181/230
4,212,370 7/1980 Dreher et al. ..... 181/230

FOREIGN PATENT DOCUMENTS 58-46880 9/1956 Japan .
57-23796 5/1982 Japan .
57-153795 9/1982 Japan ..... 418/63
59-46383 3/1984 Japan .
59-43996 3/1984 Japan .
59-105980 6/1984 Japan .
60-56195 4/1985 Japan ..... 418/181
60-240893 11/1985 Japan ..... 418/181

*Primary Examiner*—John J. Vrablik
*Attorney, Agent, or Firm*—Foley & Lardner, Schwartz, Jeffery, Schwaab, Mack, Blumenthal & Evans

[57] ABSTRACT

A rotary compressor comprises a rotary shaft for compression action, a bearing which supports the rotary shaft and includes a discharge valve to discharge compressed gas and a sound suppression cover which covers the discharge valve, so that an annular discharge chamber is formed between the sound suppression cover and the bearing. At least one tubular cavity section with a bottom is provided to open into the discharge chamber at a location adjacent the discharge valve. The tubular cavity section has a length approximately one-fourth of the average circumference length of the discharge chamber.

24 Claims, 8 Drawing Sheets

FIG. 6 (a)
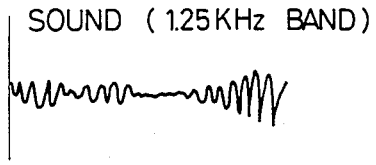
FIG. 6 (b)
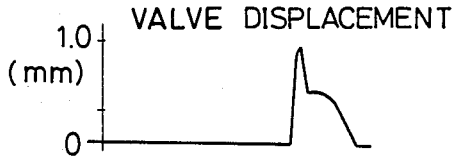
FIG. 6 (c)
FIG. 6(d)
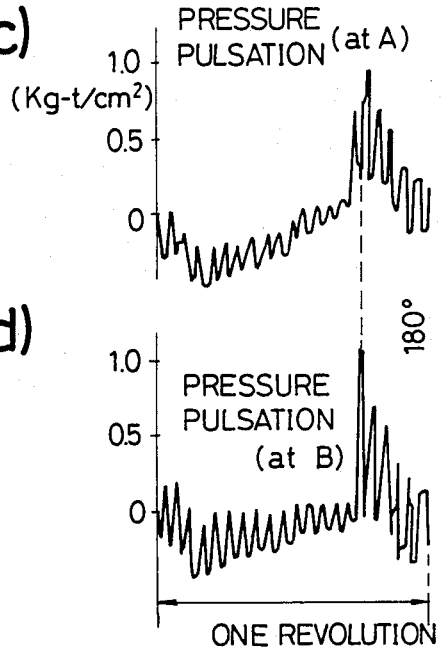

ROTARY COMPRESSOR WITH SOUND SUPPRESSION TUBULAR CAVITY SECTION

This application is a continuation, of application Ser. No. 904,294, filed Sept. 8, 1986, now abandoned.

BACKGROUND OF THE INVENTION

1. Field of the Invention

The present invention relates to a rotary compressor, and, in particular, to a rotary compressor wherein the sound resulting from the pressure pulsations of the discharge gas discharged from between the bearing and the silencer cover which covers the bearing is efficiently reduced.

2. Description of the Related Art

Generally, the pressurizing element of a rotary compressor, which has been adopted for a cooling cycle and the like, mainly comprises a cylinder, a main bearing, an auxiliary bearing, a rotating shaft, a roller, and a blade. The compressor is driven by the rotation of the rotary shaft which is connected to a transmission element provided in its upper part. The rotary shaft is supported by the main bearing and the auxiliary bearing, and the main bearing and the auxiliary bearing cover the upper side and the lower side of an annular cylinder, in which a compression space is formed. Within this compression space, the roller is provided in an eccentric shaft portion of the rotary shaft and rolls against the inner wall of the cylinder. The interior of the compression section is divided into a high pressure side and a low pressure side by a blade which is provided in a freely sliding manner on the cylinder in contact with the roller.

For this type of rotary compressor, both an auxiliary bearing discharge type and a main bearing discharge type are known. Specifically, a discharge port is provided in the main bearing or in the auxiliary bearing, and this port communicates with the high pressure side in the compression space. A discharge valve or a check valve is provided in this discharge port.

One end of the discharge valve is secured to the bearing, while the other end, which is the free end, is seated on the discharge port and acts to seal this port. When the pressure inside the compression space becomes higher than a set pressure, the free end of the discharge valve draws away from the discharge port and the compressed gas is discharged. Accordingly, a discharge noise is developed, caused by the discharge gas.

Generally, if the frequency of the noise from a rotary compressor is analyzed, it is found to have three modes. These are the 100 to 500 Hz low frequency sound, made up of the vibration sound from the rigid body of the compressor and electromagnetic sound, the 630 Hz to 2 KHz medium frequency sound, and the high frequency sound above 2.5 KHz. Among these, the medium frequency sound is the most obvious, so that it is desirable to suppress the sound from the discharged gas in this frequency range.

Accordingly, in order to suppress this sound from the discharge gas, the provision of various devices such as a sound suppression cover with a vent which covers the discharge port and discharge valve has been adopted.

The sound supression cover is also referred to as a valve cover or a discharge cover.

For example, in the Japanese Patent Publication of Unexamined Application No. SHO-59-43996, a discharge orifice is provided at the side of the discharge port to alleviate the force of the shock received by the valve seat when the discharge valve is closed. Also, in the Japanese Patent Publication of Unexamined Application No. SHO-57-23796, the speed of closure of the discharge valve is adjusted, using a guide element, to cushion the shock received by the valve seat when the valve is closed. In both of these cases the sound in the high frequency range caused by the shock to the discharge valve is suppressed.

Next, the cause of development of medium frequency noise is considered to be the pressure pulsations produced within the sound suppression cover which covers the discharge valve. To suppress the noise caused by this type of pressure pulsations, for example, in the Japanese Patent Publication of Unexamined Application No. SHO-59-46383, a tubular body for suppression of sound is provided as a side branch type sound suppressor in a discharge chamber formed in the space between the sound suppression cover and the bearing. In addition, in the Japanese Utility Model Publication of Unexamined Application No. SHO-58-46880, there is provided a tubular body or a cavity section with a bottom which opens into a discharge chamber formed from a sound suppression cover of the type provided on the bearing as previously described. The same type of cavity section is disclosed in the Japanese Patent Publication of Unexamined Application No. SHO-59-105980.

These publications are incorporated into the present specification by reference.

In the conventional structure of these examples, the cavity section with bottom for the side branch type of sound suppression opens into the discharge chamber at a position offset by 180 degrees from the position of the discharge port. Because of this, the phase of the pressure pulsations produced within the discharge chamber is reversed, so that the pressure vibrations produced in the discharge chamber are offset and the sound is suppressed or attenuated. This configuration is based on the following considerations.

Specifically, for the pressure pulsations when the compressed gas is discharged from the discharge port, at a certain instant, half of the region of that discharge port side in the annular discharge chamber becomes a positive pressure wave region. As opposed to this, half of the region of the opposite side offset at an angle of 180 degrees to that discharge port becomes a negative pressure wave region. Then, in the next instant, the plus and minus pressure pulsations reverse. This produces a pressure pulsation standing wave. Accordingly, the cavity section with bottom may be placed anywhere within the discharge chamber, but mainly, to improve ease of processing or installation, it is placed at 180 degrees from the discharge port. However, with this configuration, effective suppression of the pulsations is not adequately obtained. Accordingly, it is believed that further improvement is required in the setting of the conventional cavity section with bottom.

SUMMARY OF THE INVENTION

A first object of the present invention is to provide, with due consideration to the drawbacks of such conventional devices, a rotary compressor wherein the discharge sound caused by the pressure pulsations of the discharge gas is effectively reduced.

A second object of the present invention is to provide a rotary compressor wherein the use of the side branch type of sound suppressor or attenuator is adequately demonstrated, and the output gas noise is suppressed with a simple configuration.

A third object of the present invention is to provide a rotary compressor wherein, in the case where the cavity section of a side branch type sound suppressor or attenuator is adopted in the main bearing discharge system, the bottom section of the cavity section is prevented from being positioned lower than the discharge valve, and when the compressor is operating, the retention of oil in the cavity section which would reduce the length of the cavity is avoided, and it is possible to maintain an adequate and effective suppression or attenuation of the noise of the discharge gas.

A fourth object of the present invention is to provide a rotary compressor wherein the installation of a side branch type of noise suppressor or attenuator is only slightly effected by the existence of other structural elements of the compressor.

In order to accomplish these objects of the present invention, in the rotary compressor of the present invention, the phase of the high pressure component of the pressure pulsations in the discharge gas produced in the discharge chamber is reversed at the tubular cavity section by the provision of a tubular-shaped cavity section with a bottom which opens into the discharge chamber close to the discharge port on the bearing, whereby those pressure pulsations are reduced with good efficiency.

BRIEF DESCRIPTION OF THE DRAWINGS

This and other objects, features, and advantages of the present invention will become more apparent from the following description of a preferred embodiment taken in conjunction with the accompanying drawings, in which:

FIGS. 6(*a*) to 6(*d*) are graphs showing the pressure changes in the discharge chamber in relation to the sound.

DESCRIPTION OF THE PREFERRED EMBODIMENT

Following is a description of preferred embodiments of the present invention, with reference to the drawings.

Figure 1:
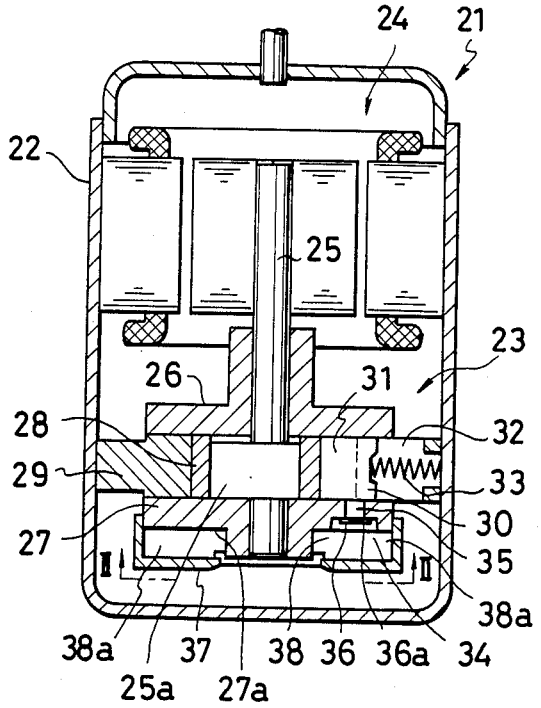
FIG. 1 is a side sectional view showing one preferred embodiment of a rotary compressor of the present invention.
Figure 2:
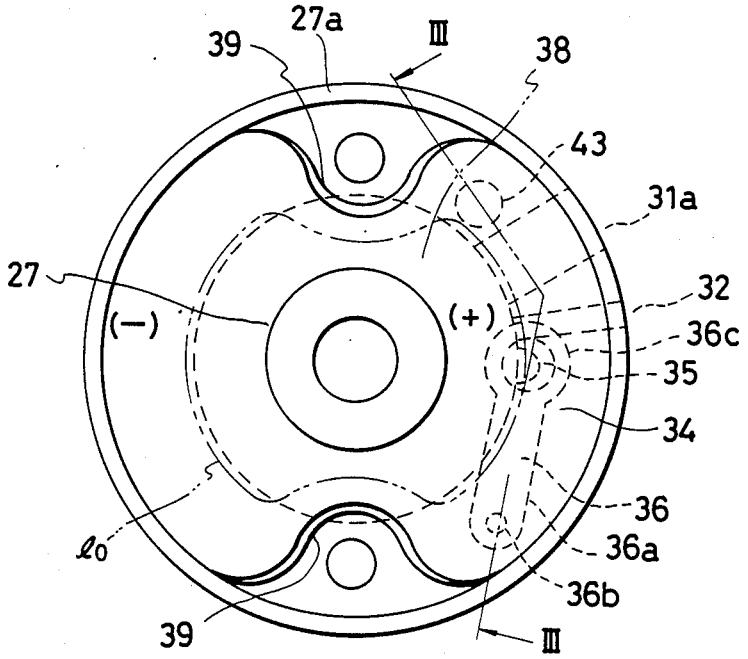
FIG. 2 is a view along the line II—II in FIG. 1 in the direction of the arrow.

Now referring to FIG. 1 and FIG. 2, a rotary compressor 21 comprises a compression element 23 in the lower section of a hermetically sealed casing 22, and a transmission element 24 positioned in the upper section of the hermetically sealed casing 22. The transmission element 24 and the compression element 23 are connected to a rotary shaft 25. The rotary shaft 25 is supported by a main bearing 26 and an auxiliary bearing 27 of the compression element 23.

The compression element 23 mainly comprises the main bearing 26 and the auxiliary bearing 27, the rotary shaft 25 and an eccentric shaft section 25*a*, a roller 28, a cylinder 29, and a blade 30. The cylinder 29 is formed in the shape of a ring and is secured to the sealed casing 22. The main bearing 26 and the auxiliary bearing 27 are provided on the upper section and lower section respectively of the cylinder 29, and a compression space 31 is formed between them. The roller 28 which engages with the eccentric shaft section 25*a* of the rotary shaft 25 is provided in the compression space 31. The roller 28 is caused to roll against the inside wall surface of the cylinder 29 by the rotation of the rotary shaft 25. Also, a blade 30 is provided in a freely sliding manner in a blade channel 32 formed in the cylinder 29. The blade 30 is energized by a spring 33 and its tip section contacts the roller 28 and thus divides the compression space 31 into a high pressure chamber side and a low pressure chamber side. A suction tube 31*a* communicates with the low pressure chamber.

A discharge mechanism 34 is provided on the auxiliary bearing 27 to discharge a fluid (cooling medium) compressed in the compression space 31 inside the compression element 23 to the outside when this fluid exceeds a prescribed pressure. The discharge mechanism 34 comprises a discharge port 35 and a discharge valve 36 which serves to open and close the discharge port 35. A sound suppression cover 37 with a vent 37*a* is mounted on the lower side of the auxiliary bearing 27 and forms a discharge chamber 38 covering the discharge mechanism 34.

The sound suppression cover 37 is formed almost in the shape of a ring. A constricted section 39 is provided at two locations in symmety on the circumference of the sound suppression cover 37 at a location at an angle of 90 degrees from the discharge port 35. The outside section of the constricted section 39 is secured to a flange section 27*a* of the auxiliary bearing 27 by a bolt or the like. The constricted section 39 may be provided in more than two places.

Figure 3:
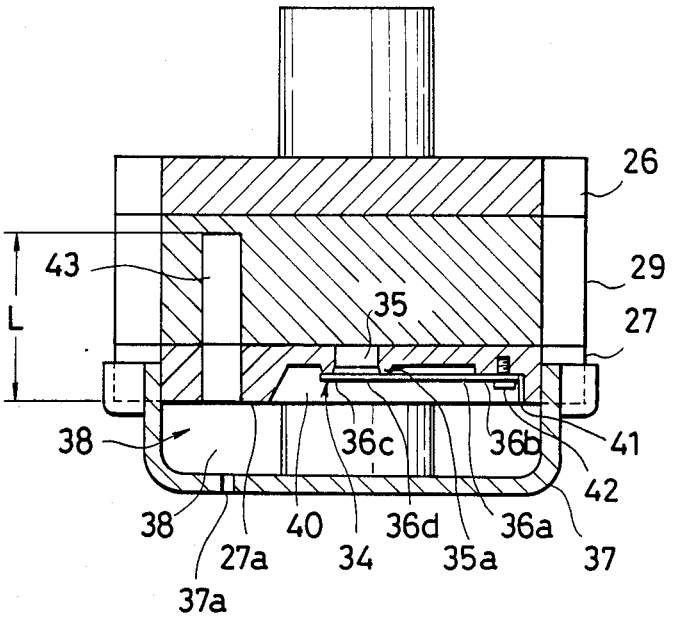
FIG. 3 is a sectional view taken along the line III—III in FIG. 2 in the direction of the arrow.

As shown in FIG. 2 and FIG. 3, the discharge valve 36 comprises a reed valve 36*a*. A channel section 40 is formed in a flange section 27*a* of the auxiliary bearing 27 to house the reed valve 36*a*. The discharge port 35 opens into the channel section 40. The reed valve 36*a* is formed out of flat plate. One end of the reed valve 36*a* is a fixed end 36*b* which is secured in a cantilever manner with a screw 42 or the like on a flat, fixed surface formed in the channel section 40. A free end 36*c*, which is the other end of the reed valve 36*a*, becomes a valve body section 36*d*, and is seated in a valve seat section 35*a* of the discharge port 35, to open and close the discharge port 35.

The compressed gas from the compressor element 23 is periodically discharged into the discharge chamber 38 by the opening and closing of the discharge valve 36 so that noise is produced. The inventors of the present invention have measured this noise.

The results are explained below.

Figure 4:
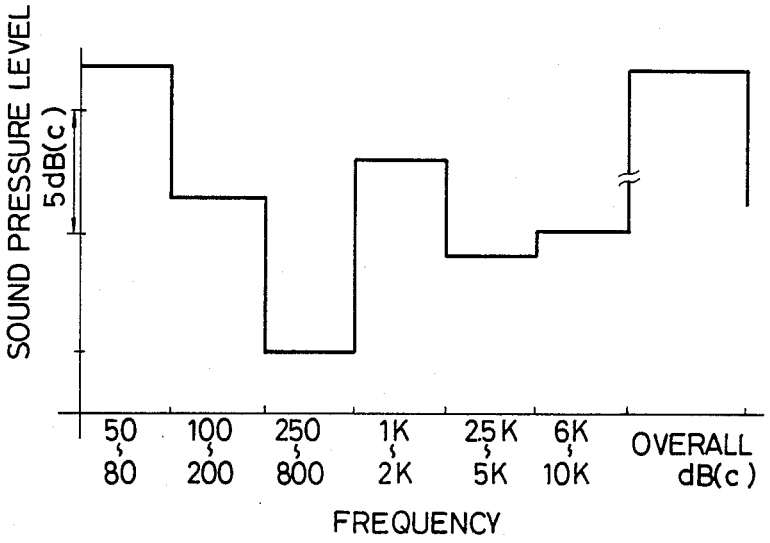
FIG. 4 is a graph showing the relationship between the sound produced by the rotary compressor and the frequency region.
Figure 5A:
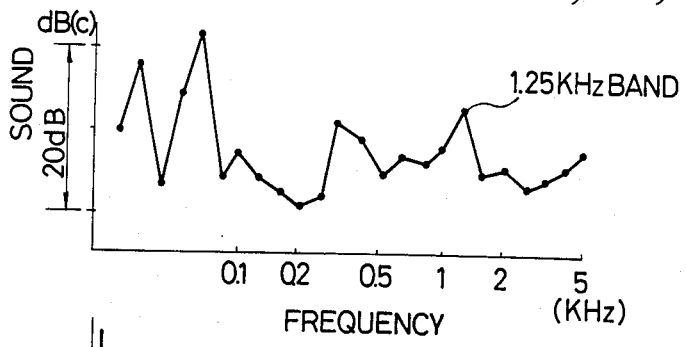
FIGS. 5(*a*) to 5(*d*) are graphs showing the measured results of the compressor sound corresponding to the frequencies.
Figure 5B:
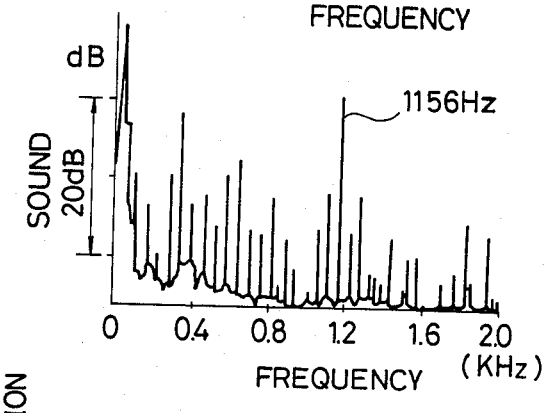
Figure 5C:
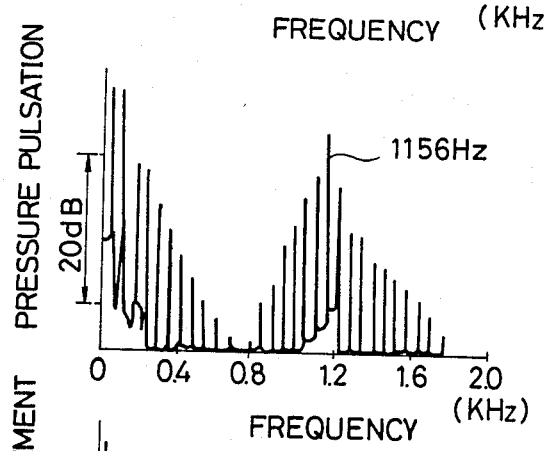
Figure 5D:
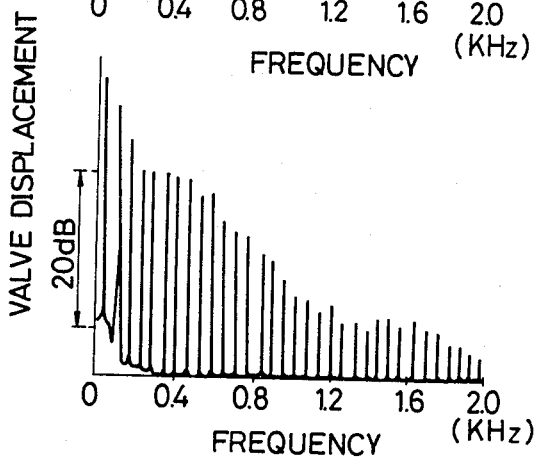

FIG. 4 shows the relation between the sound produced in the rotary compressor and the frequency region. The vertical axis is the sound, while the horizontal axis shows the frequency. From this graph it is seen that the sound from the compressor has three modes—a low frequency, a medium frequency, and a high frequency region. The intent of the present invention is to attempt to deal successfully with the sound in the medium frequency range which is believed to be caused by the pressure pulsations in the discharge chamber.

FIGS. 5(*a*) to 5(*d*) show the relationship between the sound, the pressure pulsations in the discharge chamber and the displacement of the discharge valve, and the frequencies. The pressure pulsations in the discharge chamber were measured by a pressure sensor (A) placed at an angle of 45 degrees from the discharge port and a pressure sensor (B) placed at an angle of 180 degrees from the pressure sensor (A). A valve displacement sensor is buried in a valve stopper immediately above the discharge port, and the displacement of the discharge valve is measured in a non-contact status. A microphone for measuring the sound is positioned 100 mm away from the surface of the compressor casing.

Figure 12:
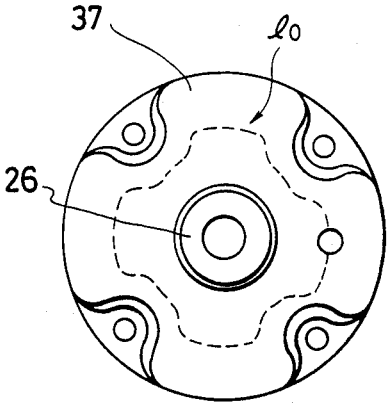

The compressor sound suppression cover used in these measurements is secured in four places. Specifically, the four constricted sections 39 are provided as shown in FIG. 12.

FIG. 5(*a*) gives the results of a ⅓ octave analysis of the sound. As seen in this graph, the main brand in the 630 Hz to 2 KHz medium frequency sound is 1.25 KHz. Also, from analysis of the narrow band sound range in FIG. 5(*b*), the main spectrum is judged to be 1156 Hz. The displacement of the discharge valve at this time, shown as valve displacement in FIG. 5(*d*), indicates that there is practically no relation to the main sound spectrum. The main spectrum for the pressure pulsations at (A) measured in the discharge chamber as deduced from FIG. 5(*c*), shown as pressure pulsations, is exactly the same as the main spectrum of the sound, that is, 1156 KHz.

FIG. 6 shows relationships between the sound during one revolution of the rotary shaft (the 1.25 KHz band only), the valve displacement, and the pressure pulsations (sensors A and B). From these graphs it is seen that directly after the opening of the discharge valve, pressure pulsations are produced in the discharge chamber, accompanied by the production of sound. No further sound is observed to be produced when the discharge valve is closed. Furthermore, the phase difference for the pressure pulsations (A) and (B) measured at mutually opposed positions in the discharge chamber is 180 degrees.

It should be noted that as shown by the valve displacement in FIG. 6(*b*), the pressure pulsations produced at the same time as the discharge valve is opened. Simultaneously, the sound is produced as shown in FIG. 6(*a*). From this it is seen that the sound is caused by the pressure pulsations, and it can be confirmed that this is not the so-called valve shock sound.

Figure 7A:
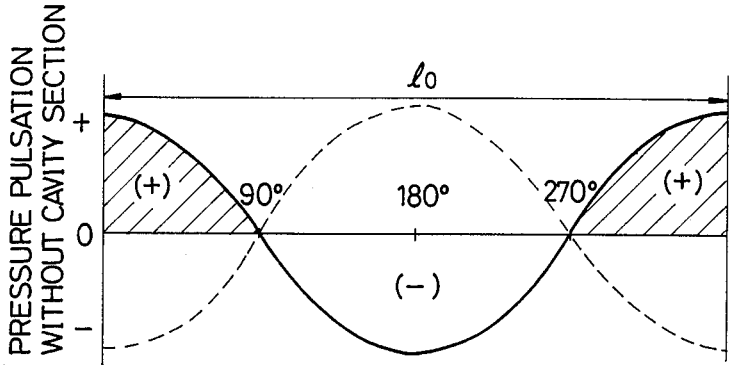
FIGS. 7(*a*) and 7(*b*) are graphs showing the standing waves of the pressure pulsations.
Figure 7B:
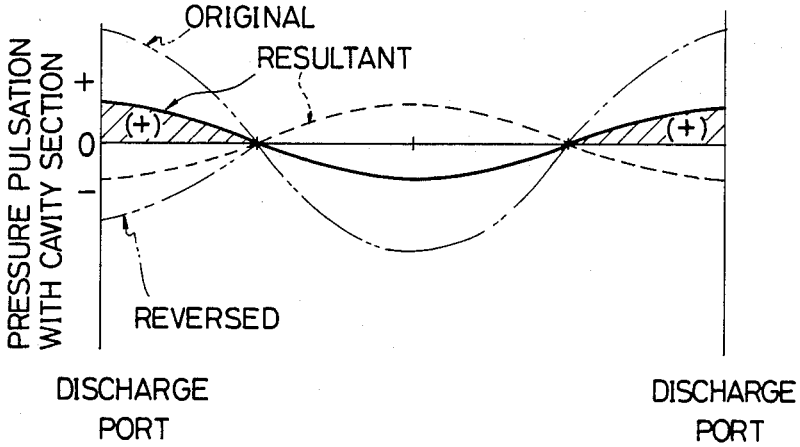

In the case where no sound suppression device is provided in the discharge chamber, the pressure distribution within the discharge chamber is considered to be in the form of a standing wave as shown in FIG. 7(*a*). The standing wave has, at a certain time, a maximum value in the high pressure (positive) region, and has a minimum value in the low pressure (negative) region. Then, the pressure distribution oscillates between the solid line and dotted line in FIG. 7(*a*), and pressure pulsations are created. On examining the status in FIG. 2, taking the constricted section as the boundary, the left half and the right half of the discharge chamber are seen to alternate between positive and negative regions.

In the present invention, it was unexpectedly discovered that by the provision of a side-branch type tubular cavity section 43 close to the discharge valve, a larger sound suppression effect is obtained than in the case where the tubular cavity section 43 is located on the opposite side at 180 degrees to the discharge valve.

In the embodiment of the present invention shown in FIG. 2, the tubular cavity section 43 is formed with a bottom so that it penetrates the flange section 27*a* of the auxiliary bearing 27 and extends to the cylinder 29. The pressure pulsations produced in the discharge chamber 38 are offset by the fact that the phase of the high pressure component of the pressure pulsations within the tubular cavity section 43 is reversed, whereby the pressure pulsations are efficiently reduced.

Specifically, the tubular cavity section 43 is provided close to the discharge port 35 within a sector region of 90 degrees between the discharge port 35 and the constricted section 39, on the opposite side of the discharge port 35 with reference to the fixed end 36*b* of the discharge valve 36.

The word "tubular" does not only refer to the case of a circular cross-section, but includes other forms of cross-sections.

It is not clearly understood why the sound suppression effect increases by means of the side-branch type sound suppressor, specifically, the tubular cavity section close to the discharge port. For example, the following type of reasoning is possible. For the standing wave pattern, as shown in FIG. 7(*a*), it can be considered that, because of having the same maximum values at the discharge port and the side 180 degress opposite, the tubular cavity section 43 can be placed at any position close to the maximum value. However, in actual fact, the absolute value of the pressure pulsations in the side opposite the discharge port is generally rather smaller than the absolute value of the pressure pulsations in the discharge port side because of the constricted sections 39 in the discharge chamber 38. Even if this part is provided with the tubular cavity section, it is considered that the sound suppression effect becomes smaller as the absolute value of the pressure pulsations are smaller.

Next, the significance of being close to the discharge port will be explained. To maximize the sound suppression effect, the tubular cavity section should be provided in the area of the discharge port. However, in actual fact it is difficult to form the tubular cavity section within the bearing right next to the discharge port because of the existence of a suction pipe and the discharge valve. Accordingly, the tubular cavity section is provided in a position within 90 degrees of the discharge port.

It is known that sound suppression or attenuation in the sound range 10 dB or more (energy) below the peak or maximum sound value makes no contribution. Accordingly, if a tubular cavity section is provided in a high sound range 10 dB or less below the maximum value of pressure pulsations at the discharge port, the desired sound suppression effect is obtained. Because of this, it is decided that the tubular cavity section must be provided within an angle of 70 degrees from the discharge port.

In operation, the compressed gas presses down the reed valve (discharge valve) 36*a* and flows out of the discharge port 35 into the discharge chamber 38, and also flows in the peripheral or circumferential direction. At this time, if, for example, an average circumference length of lo is taken into consideration, as shown in the graphs in FIG. 5, pressure pulsations with a primary frequency fl (wave length $\lambda$=lo) of the standing wave corresponding to the average circumference length lo, are developed inside the discharge chamber 38. The positive component of the pressure pulsations formed in the vicinity of the discharge port are led into the tubular cavity section 43. However, because this tubular cavity section is formed with a length L which is about $\frac{1}{4}$ of the average circumference length lo of the discharge chamber 38, the sound is reflected at that closed end, and when it is sent back into the discharge chamber 38, the phase is reversed. For this reason, the pressure pulsations which have their phase reversed and are returned into the discharge chamber 38, and the pressure pulsations which flow into the peripheral direction in the discharge chamber 38 are offset. As a result, the amplitude of the pressure pulsations produced in the discharge chamber 38 is suppressed and the pulsations are reduced. Accordingly, the discharge sound from the section of the compression element 23, which is caused by these pressure pulsations, is reduced.

With respect to the arrangement of the side branch type of tubular cavity section, two adjacent tubular cavity sections may be positioned in the discharge chamber 38. The length of these two tubular cavity sections can be about $\frac{1}{4}$ of the average circumference length lo of the dishcharge chamber. With a plurality of tubular cavity sections provided in this way, the amplitude of the pressure pulsations can be even more suppressed, and these pressure pulsations can be even further reduced. In addition, the lengths of the two tubular cavity sections may be different. Specifically, one of the tubular cavity sections can, as described above, have a length about $\frac{1}{4}$ of the average length lo of the circumference of the discharge chamber with the length of the other tubular cavity section being about $\frac{1}{8}$ of the average length lo, and the secondary frequency f2 of the primary pulsation frequency f1 determined from the average circumference length lo of the discharge chamber can also be reduced. Specifically, with the secondary frequency $f2=2\times f1$, if the speed of sound is C, $f1=C\times 1/lo$, so that $f2=C\times 2/lo$, and the wave length $\lambda_2$ of the secondary frequency becomes lo/2. Accordingly, to reduce the pressure pulsations at the secondary frequency, the length of the tubular cavity section should be about $\frac{1}{8}$ of the average circumference length lo of the discharge chamber.

Furthermore, it is also acceptable to provide a discharge mechanism for both the main bearing 26 and the auxiliary bearing 27 for the compression element 23, and to provide a sound suppression cover for the main bearing 26 and the auxiliary bearing 27, respectively, to cover the discharge mechanism and form the discharge chamber, and to form one tubular cavity section or more in the discharge chamber.

The embodiments formed in this manner demonstrate the following superior effects.

(1) In the bearing of the compression element having the discharge mechanism, a sound suppression cover is provided to cover that discharge mechanism, forming a discharge chamber. In this discharge chamber, a tubular cavity section with bottom is opened close to the above-mentioned discharge mechanism. The pressure pulsations produced in the discharge chamber are introduced into the tubular cavity section and have their phase reversed. They are then sent back into the discharge chamber so that the pressure pulsations produced in the discharge chamber can be reduced with good efficiency.

(2) As a result of the reduction of the pressure pulsations produced in the discharge chamber, the discharge noise from the compression element caused by these pressure pulsations can be reduced or attenuated.

(3) If two tubular cavity sections are provided close to the discharge mechanism for the discharge chamber, and if the length of one of the tubular cavity sections is about $\frac{1}{4}$ of the average circumference length of the discharge chamber and the length of the other tubular cavity section is about $\frac{1}{8}$ of the average circumference length of the discharge chamber, both the primary and secondary wave length components of the pressure pulsations produced in the discharge chamber can be reduced.

In the previous embodiments of the present invention, since the tubular cavity section is formed in the bearing, it is difficult to form the tubular cavity section close to the discharge port, because of the existence of the suction pipe and the discharge valve.

Configurations which allow the tubular cavity section to be close to the discharge port are shown in FIG. 8 to FIG. 20.

Figure 8:
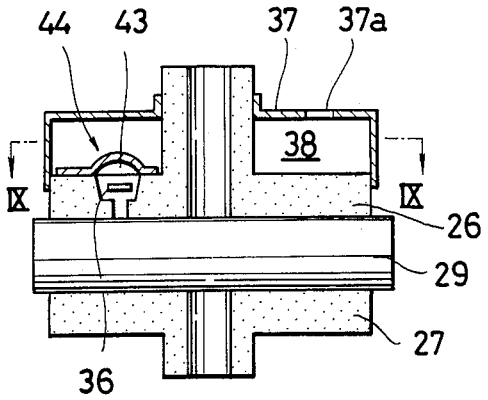
FIG. 8 is a sectional drawing showing another embodiment of the present invention.
Figure 9:
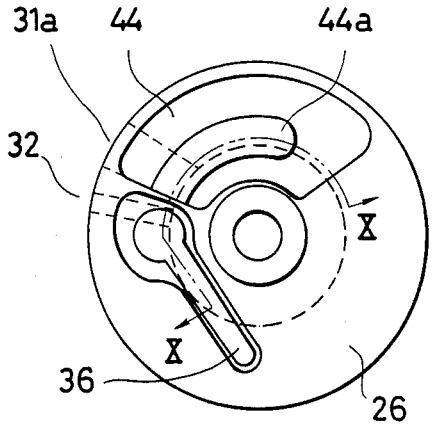
FIG. 9 is a view along the line IX—IX in FIG. 8 in the direction of the arrow.

As shown in FIG. 8 and FIG. 9, the main bearing 26 and the auxiliary bearing 27 are provided on the opposite sides of the cylinder 29.

The discharge valve 36 is provided in the main bearing 26, while the sound suppression cover 37 covers this main bearing 26 to form the discharge chamber 38.

The sound suppression cover has the vent port 37*a* to cause the discharge gas therein to be discharged outside.

Figure 10:
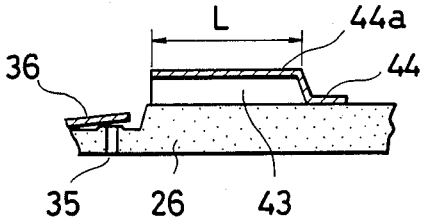
FIG. 10 is a sectional view taken along the line X—X in FIG. 9 in the direction of the arrow.

This embodiment of the present invention has the special feature that the cavity section 43, which is a side branch type of sound suppressor for suppressing the noise in the discharge gas discharged into the discharge chamber 38 formed between the sound suppression cover 37 and the main bearing 26, is formed of a plate. As shown in FIG. 8 to FIG. 10, this cavity section 43 is formed above the discharge valve 36 by a sector-shaped partition plate 44 and the main bearing 26.

Figure 11:
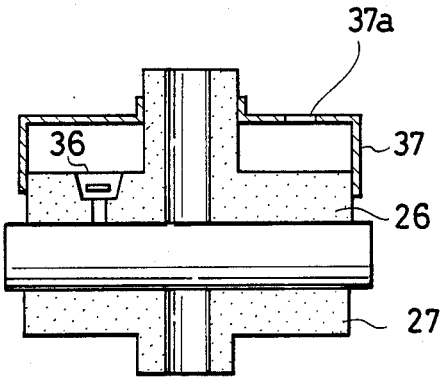
FIG. 11 and FIG. 12 are a sectional view and a plan view, respectively, showing the average length lo of the empty section of the discharge chamber.

Specifically, the partition plate 44, for example, which is formed by a pressing process, has a convex section 44*a*. Here, the term "convex" means that the section is convex on one side thereof and concave on the opposite side thereof facing the main bearing 26. Its one end lines up with the end of the partition plate 44, and opens into the discharge chamber 38 close to the discharge valve 36, while the other end is closed up, so that the concealed cavity section 43 is formed between the main bearing 26 and the partition plate 44. In addition, the convex section 44*a* of the partition plate 44 is formed such that its length L in the longitudinal direction is approximately $\frac{1}{4}$ of the average length lo of the discharge chamber 38 which is formed by the main bearing 36 and the sound suppression cover 37 as shown in FIG. 11 and FIG. 12.

In this embodiment of the present invention, the processing of the cavity section is easily carried out in one pressing, and the cavity section can easily be provided adjacent to the discharge port, specifically, in a region within an angle of 70 degrees from the discharge port.

In addition, the cavity section 43 is formed at a higher position than the discharge valve 36 so that different from the case where the cavity section is provided in the main bearing, there is formed no oil pool in the cavity section, and the sound suppression effect can be effectively continued.

Further, with the simple configuration wherein the partition plate 44 is only mounted on the main bearing 26, the cavity section 43 can be formed. In addition the cavity section 43 is formed between the main bearing 26 and the sound suppression cover 37. Accordingly, there is a high degree of freedom in setting the dimensions of the cavity section 43, so that ideal dimensions can be set.

In addition, the cavity section 43 with one end open and the other end closed, has no adverse effect on the recirculation of a coolant, and the pressure pulsation component only can be reduced so that there is no drop in the efficiency of the compressor.

Figure 13:
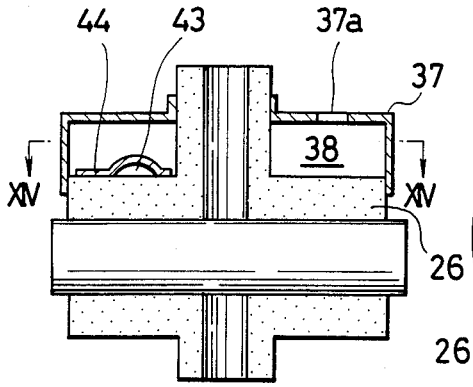
FIG. 13 is a sectional drawing of another embodiment of the present invention similar to FIG. 8.
Figure 14:
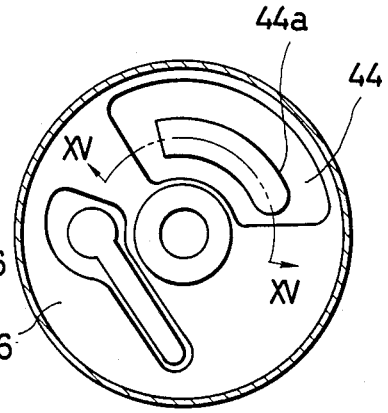
FIG. 14 is a plan view taken along the line XIV—XIV in FIG. 13 in the direction of the arrow.
Figure 15:
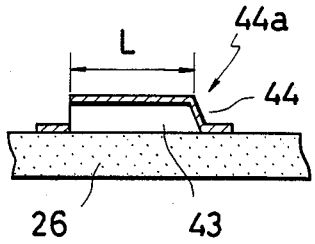
FIG. 15 is a sectional view taken along the line XV—XV in FIG. 14 in the direction of the arrow.

As an example of a modification of this embodiment of the present invention, in FIG. 13 to FIG. 15, the convex section 44*a* is formed, by, for example, a pressing process in the center of the partition plate 44, and one part of the convex section 44*a* is cut out or opened during the pressing process with a notch means. By this means, the cavity section 43 is formed between the partition plate 44 and the main bearing 26.

Figure 16:
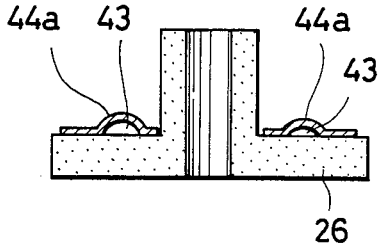
FIG. 16 is a sectional view of another embodiment of the present invention similar to FIG. 8.
Figure 17:
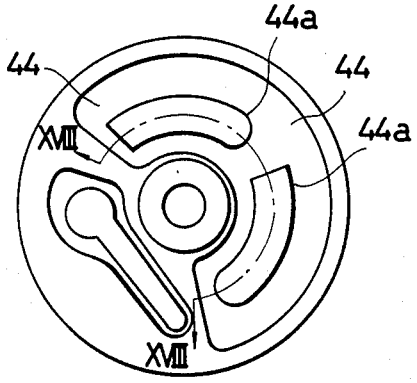
FIG. 17 is a plan view of FIG. 16.
Figure 18:
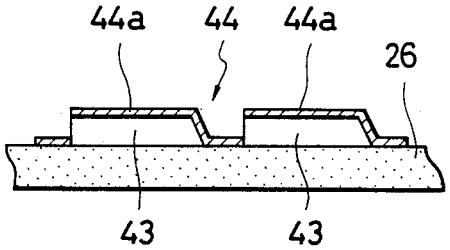
FIG. 18 is a sectional view taken along the line XVIII—XVIII in FIG. 17 in the direction of the arrow.

FIGS. 16, 17, and 18 show an example of the formation of a plurality of the cavity sections 43. In the example shown in the drawings, two convex sections 44*a* are formed on one partition plate 44, and the convex sections 44*a* have one end opened by a pressing process as in the case mentioned above. The discharge gas can have its noise suppressed even further by the provision of a plurality of cavity sections 43 in this manner.

Figure 19:
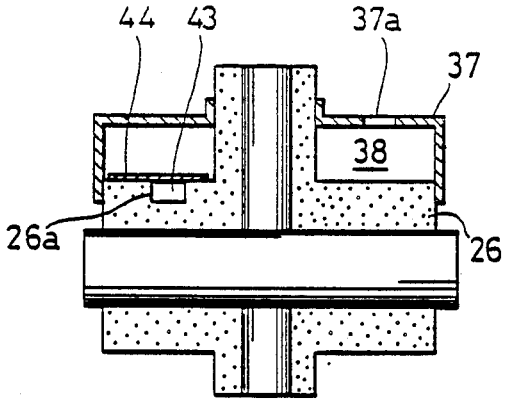
FIG. 19 is a sectional view of another embodiment of the present invention showing the cavity section being formed between a partition plate and the main bearing.

Next, as another embodiment of the present invention, the cavity section may be formed between a partition plate in flat plate form, having an open section, and the main bearing provided with a concave section as illustrated in FIG. 19. In addition, the cavity section may be formed from a convex section on the partition plate and a concave section formed on the main bearing.

Further, the partition plate can be formed so that both of the discharge valve and the boss section of the main bearing are enclosed by the plate, and the cavity section can be formed from the formation of a convex section with an opening on the partition plate by the pressing operation.

Figure 20:
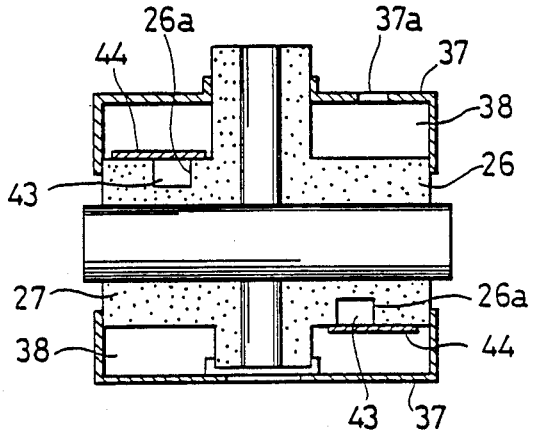
FIG. 20 is a sectional view of another embodiment of the present invention showing the cavity section being formed between the auxiliary bearing and the sound suppression cover.

In the above embodiments, the explanation has been made with reference to a main bearing discharge type of rotary compressor, but the cavity section can just as readily be formed in the auxiliary bearing. Specifically, the cavity section can be formed between the auxiliary bearing and the sound suppression cover which covers that bearing as illustrated in FIG. 20.

In addition, the partition plate can be secured to the sound suppression cover to form the cavity section between the two of them.

The embodiments outlined above demonstrate the following superior effects.

(1) A cavity section is formed from a partition plate between a bearing and a sound suppression cover covering the bearing to form a cavity section on the surface of the bearing with one end thereof opened close to a discharge valve and the other end closed. From this configuration, highly effective suppression of the discharge gas noise is possible, and because the cavity section is positioned above the discharge valve, the noise suppression effect is kep well over a long period of time.

(2) The configuration is simple, with the partition plate mounted on a bearing, so that the cavity section can be formed by a pressing process.

(3) Because the cavity section is formed between the bearing and the sound suppression cover, it is easy to set ideal dimensions for the length of a plurality of cavities and cavity sections, and an extremely high sound suppression effect is possible.

What is claimed is:

1. A rotary compressor comprising:

a rotary shaft for a compression action;

a bearing which supports the rotary shaft and in which a discharge port and a discharge valve which discharges a compressed gas is positioned;

a sound suppression cover which covers the discharge port and the discharge valve, so that an annular discharge chamber is formed between the sound suppression cover and the bearing; and at least one tubular cavity section with a bottom, said tubular cavity section opening into the discharge chamber at a location directly adjacent the discharge port such that the tubular cavity section is positioned to diverge from said location directly adjacent the discharge port, and having a length of approximately one fourth the average circumferential length of said discharge chamber, thereby producing a side branch muffler effect in that the pressure pulsations in the discharge gas produced in the discharge chamber are introduced into the cavity section and returned to the discharge chamber with the phase of the pulsations reversed.

2. The rotary compressor of claim 1, wherein the tubular cavity section is provided within an angle of 90 degrees from the discharge part about the rotary axis.

3. The rotary compressor of claim 1, wherein with the tubular cavity section is provided within an angle of 70 degrees from the discharge part about the rotary axis.

4. The rotary compressor of claim 1 wherein the tubular cavity section is provided inside the bearing.

5. The rotary compressor of claim 1 wherein the cavity section is formed on the surface of the bearing by a partition plate which includes a concave portion facing the surface of the bearing so that one end of the cavity section is opened into the discharge chamber with the other end closed.

6. The rotary compressor of claim 1, wherein the tubular cavity section is formed between a partition plate and a portion of the bearing, at least one of said partition plate and said bearing portion being provided with a concave portion so as to form the tubular cavity section with bottom between the partition plate and the bearing portion.

7. The rotary compressor of claim 1, wherein the bearing comprises a main bearing and an auxiliary bearing, and the discharge chamber is formed on at least one of the main bearing and the auxiliary bearing.

8. The rotary compressor of claim 7 wherein, the tubular cavity section is provided within an angle of 90 degrees from the discharge part about the rotary axis.

9. The rotary compressor of claim 7, wherein the tubular cavity section is provided within an angle of 70 degrees from the discharge part about the rotary axis.

10. The rotary compressor of claim 7 wherein the tubular cavity section is provided in the bearing.

11. The rotary compressor of claim 7 wherein the cavity section is formed on the surface of the bearing by a partition plate which includes a concave portion facing the surface of the bearing so that one end of the cavity section is opened into the discharge chamber with the other end closed.

12. The rotary compressor of claim 7, wherein the cavity section is formed between a partition plate and a portion of the bearing, at least one of said partition plate and said bearing portion being provided with a concave portion so as to form the tubular cavity section with bottom between the partition plate and the bearing portion.

13. The rotary compressor of claim 2, wherein the tubular cavity section with bottom is provided in the bearing.

14. The rotary compressor of claim 3, wherein the tubular cavity section with bottom is provided, in the bearing.

15. The rotary compressor of claim 2, wherein the cavity section is formed on the surface of the bearing by a partition plate which includes a concave portion facing the surface of the bearing so that one end of the cavity section is opened into the discharge chamber with the other end closed.

16. The rotary compressor of claim 3, wherein the cavity section is formed on the surface of the bearing by a partition plate which includes a concave portion facing the surface of the bearing so that one end of the cavity section is opened into the discharge chamber with the other end closed.

17. The rotary compressor of claim 2, wherein the tubular cavity section is formed between a partition plate and a portion of the bearing, at least one of said partition plate and said bearing portion being provided with a concave portion so as to form the tubular cavity section with bottom between the partition plate and the bearing portion.

18. The rotary compressor of claim 3, wherein the tubular cavity section is formed between a partition plate and a portion of the bearing, at least one of said partition plate and said bearing portion being provided with a concave portion so as to form the tubular cavity section with bottom between the partition plate and the bearing portion.

19. The rotary compressor of claim 8, wherein the tubular cavity section with bottom is provided in the bearing.

20. The rotary compressor of claim 9, wherein the tubular cavity section with bottom is provided in the bearing.

21. The rotary compressor of claim 8, wherein the cavity section is formed on the surface of the bearing with a partition plate which includes a concave portion facing the surface of the bearing so that one end of the cavity section is opened into the discharge chamber with the other end closed.

22. The rotary compressor of claim 9, wherein the cavity section is formed on the surface of the bearing with a partition plate which includes a concave portion facing the surface of the bearing so that one end of the cavity section is opened into the discharge chamber with the other end closed.

23. The rotary compressor of claim 8, wherein the tubular cavity section is formed between a partition plate and a portion of the bearing, at least one of said partition plate and said bearing portion being provided with a concave portion so as to form the tubular cavity section with bottom between the partition plate and the bearing portion.

24. The rotary compressor of claim 9, wherein the tubular cavity section is formed between a partition plate and a portion of the bearing, at least one of said partition plate and said bearing portion being provided with a concave portion so as to form the tubular cavity section with bottom between the partition plate and the bearing portion.

* * * * *